US006283820B1

(12) United States Patent
Huang

(10) Patent No.: US 6,283,820 B1
(45) Date of Patent: Sep. 4, 2001

(54) BRASSIERE PAD

(75) Inventor: Hui Lung Huang, Taipei Hsien (TW)

(73) Assignee: Strong Castle Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/668,158

(22) Filed: Sep. 25, 2000

(51) Int. Cl.[7] ..... A41C 3/10
(52) U.S. Cl. ..... 450/57; 450/38
(58) Field of Search ..... 450/38, 1, 51–58

(56) References Cited

U.S. PATENT DOCUMENTS 4,125,117 * 11/1978 Lee ..... 450/38
5,098,330 * 3/1992 Greenberg ..... 450/55
5,458,635 * 10/1995 Berman ..... 623/8
5,782,671 * 7/1998 Suen et al. ..... 450/38
6,132,288 * 10/2000 Aerts ..... 450/38

* cited by examiner

*Primary Examiner*—Gloria M. Hale
(74) *Attorney, Agent, or Firm*—Dougherty & Troxell

(57) ABSTRACT

A brassiere pad comprises an external shield, an internal lining and a sealed bag part. The external shield has an outer shield layer adhering with an inner shield layer made of foamed high molecular material. A swollen central area is surrounded by the outer edge of the external shield to form a concave inward outer chamber. The internal lining is an outer lining layer made of high molecular material adhering with an inner lining layer. A swollen central area surrounded by the outer edge of the internal lining. Both outer edges are joined together. The sealed bag part is formed between the external shield and the internal lining and disposed in the outer chamber to receive liquid therein.

6 Claims, 2 Drawing Sheets

BRASSIERE PAD

BACKGROUND OF THE INVENTION

1. Field of the Invention

The present invention relates to a brassiere pad, and particularly to a washable, non-deformed, non-crushable, soft-touching and flexible brassiere pad, which is durable for use.

2. Description of Related Art

Loving beauty is a nature of human and it is true that a well looking appearance and an elegant behavior may give others a good image easily. Therefore, the so-called beauty contest or model contest is frequently held and has never been ceased regardless the race and the territory in spite of some people of moralism criticizing these activities materialize the human beings. Hence, it can be realized that attending activities related to beauty is a part of human nature.

For a woman, her figure and her face are easily to attract the attention of others. Because a new woman belief has risen, the appearance is not the only way to evaluate a woman any more and the inner virtue has been emphasized either. Nevertheless, both the appearance and the inner virtue are worth to pursue by all women genuinely.

Undoubtedly, the breasts play an important role in second sex symbols for a woman. Originally, the breast is an organ to lactate for feeding a little baby, but it becomes a part focused by everybody's eyes. It seems a little bit amazed by us, but it is still a truth unable to be changed shortly.

Accordingly, various methods, devices, and medicines for swelling the breast are developed successively to help a woman adjusting the size of breasts. Clothes suppliers, especially the underwear supplies, endeavor to make lining pads adapted with the brassiere to perform an effective breast adjustment.

The prior art of lining pad for underwear or brassiere is usually made of sponge or soft substance filling. Alternatively, a water bag, i.e. a high molecular bag, containing liquid or other particles such as magnetic stone is sewed in the bra cups instead of sponge filling or soft substance filling.

In order to be attached to the bra cups, the water bag has to be provided with an outward flat edge integrally for being sewed to the respective bra cup. Because the water bag is not associated with the bra cup completely, it may displace away from the original place. Meanwhile, the brassiere is an article touching the body for a long time and it has to be washed frequently so that the water bag in the bra cup may damage to result in liquid inside flowing away. Furthermore, the location in the brassiere corresponding to the water bag may change it original shape to influence its visional function.

SUMMARY OF THE INVENTION

An object of the present invention is to provide a brassiere pad, which is washable, non-deformed, non-crushable, soft-touching and flexible without damage easily.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

The brassiere pad of the present invention is an independent subject, and it can be used in a woman' underwear and in an ordinary clothes.

Figure 1:
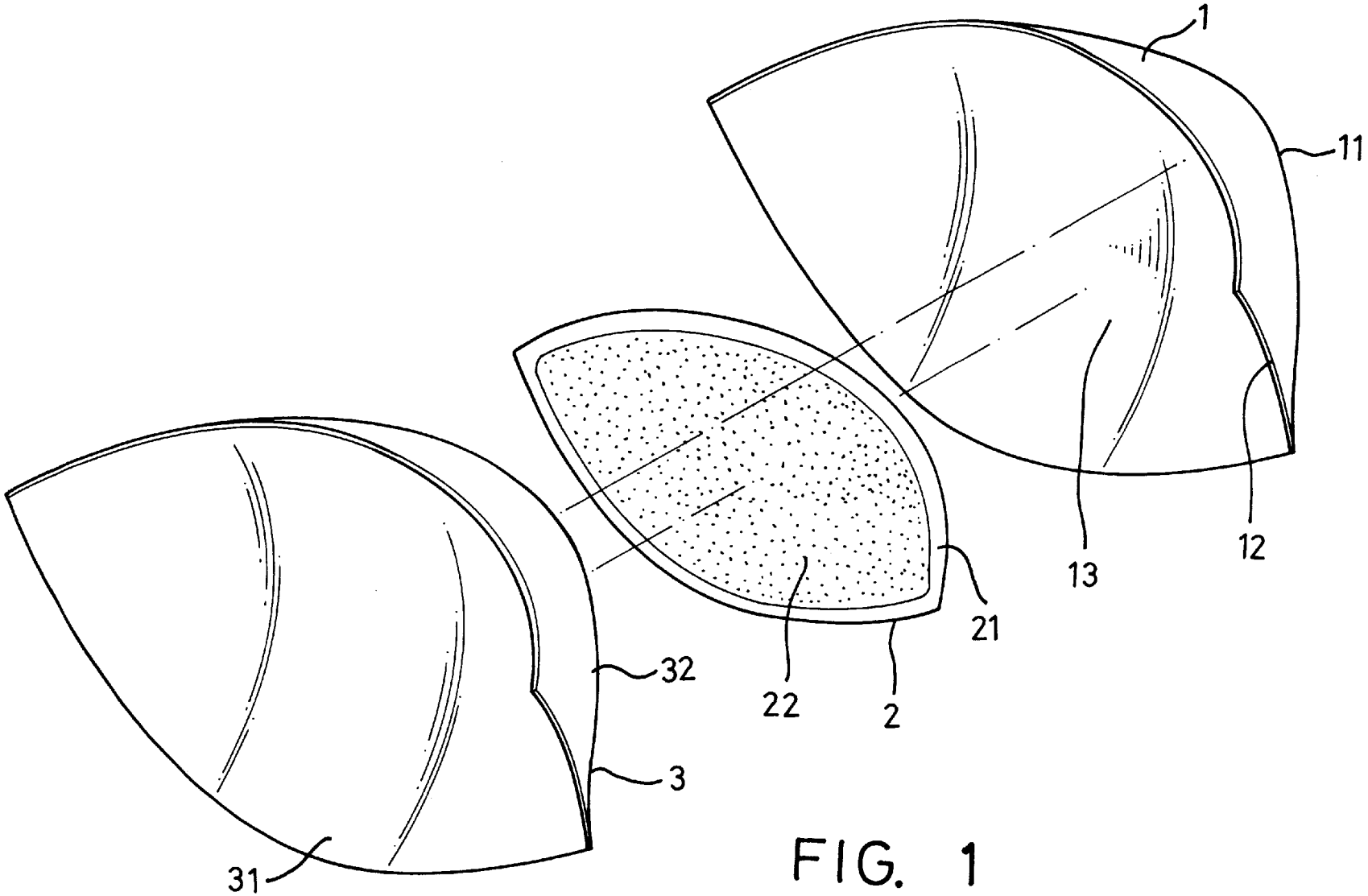
FIG. 1 is an exploded perspective view of a brassiere pad according to the present invention with a bra cup portion.
Figure 2:
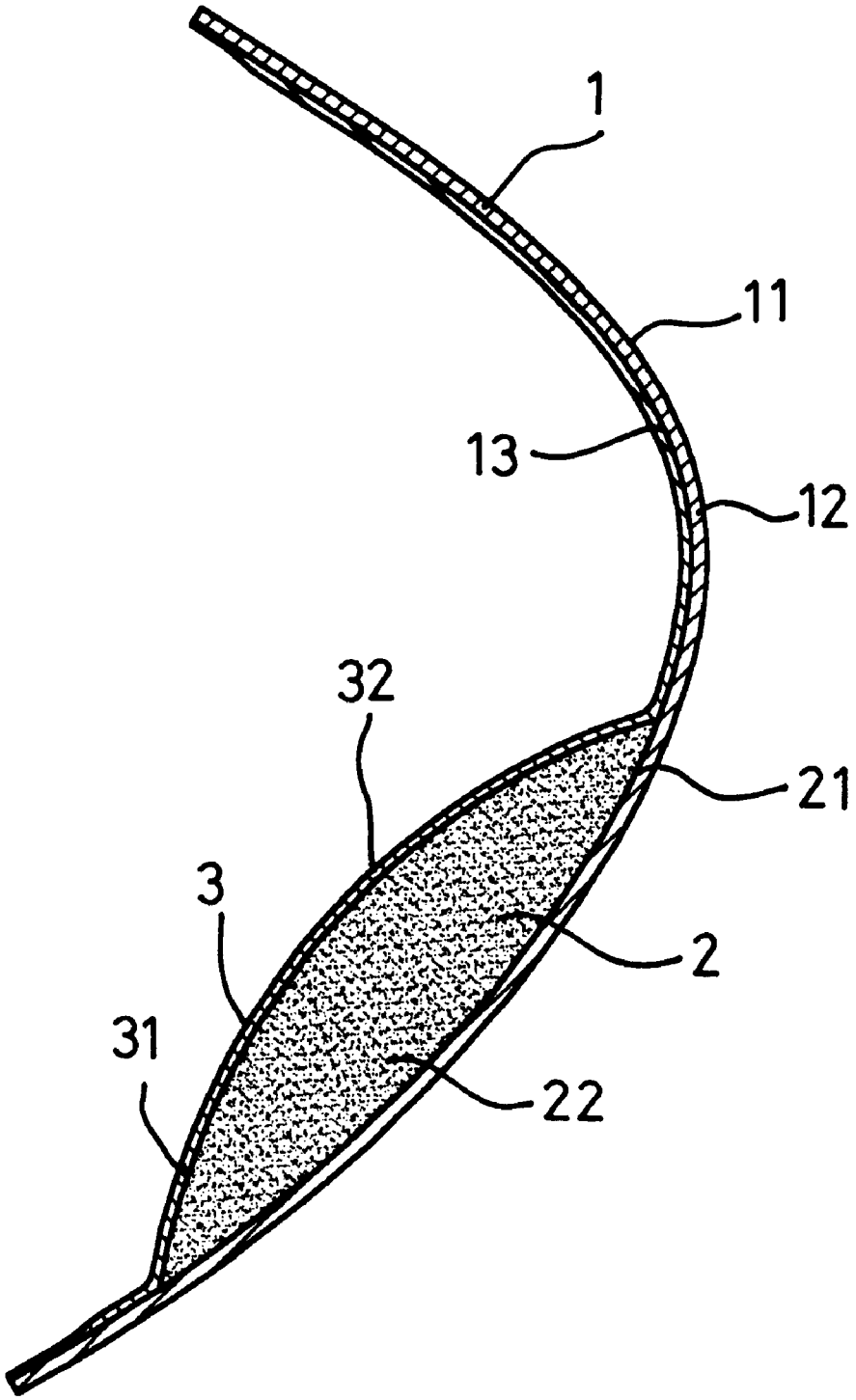
FIG. 2 is a sectional view of the brassiere pad shown in FIG. 1.

Referring to FIGS. 1 and 2, a brassiere pad of the present invention comprises an external shield 1, a bag part 2, and an internal lining 3.

The external shield 1 consists of an outer shield layer 11 and an inner shield layer 12 made of foamed high molecular material. In order to obtain a porous effect, the outer shield layer 11 may be made of non-woven cloth such as polyester yarn. The inner shield layer 12 may be made of foamed PU or the like. Meanwhile, the inner shield layer 12 is provided with a concave inward recession to form an outer chamber 13. The outer chamber 13 may be formed by way of conventional forming die.

The bag part 2 is an anti-leaked outer cover 21 and receives a kind of liquid or several different kinds of liquid 22 therein. Hence, the liquid 22 is being closed in the bag part 2. The liquid 22 may flow moderately in the bag part 2, that is, the bag part 2 preferably is not filled with the liquid 22. It is noted that the bag 2 being not filled with liquid 22 is only for taking an example and it does not to restrict the embodiment. The outer cover 21 may be made of PU cloth or the equivalent high molecular material and the liquid 22 may be water, or make-up-oil with some additives.

The internal lining 3 has approximately the same shape and size as the external shield 1 and consists of an inner lining layer 31 adhered by an outer lining layer 32. The internal lining 3 is formed by way of a forming die. The inner lining layer 31 is preferably made of woven cloth such as polyester yarn or the like as the outer shield layer does. The outer lining layer 32 is made of foamed PU or the like as the inner shield layer 12 does.

Referring to FIGS. 1 and 2 again, the process to make the brassiere pad is explained hereinafter. The bag part 2 is formed completely between the external shield 1 and the internal lining 3. Then, the outer edges of the external shield 1 and the internal lining 3 surround the bag part 2 and are adhered to each other. The external shield 1 and the internal lining 3 are adhered by way of heat or the like. Once the pad is formed, a structure of FIG. 2 may constitute, that is, the bag part 2 is the non-adhered part surrounded by the adhered part of the external shield 1 and the internal lining 3.

In order to locate the bag part 2 definitely, an adhesive may be coated or sprayed on the outer edge of the external shield 1 or on the outer edge of the internal lining 3 such that a fixing state can be performed before mold forming completely.

It is appreciated that advantages of the present invention can be summarized in the following:

1) The outer shield and the inner lining are made of woven cloth and by way of foaming so that a porous effect may generate to make user naturally comfortable while the clothes with the present invention is wore.

2) The bag part is enclosed between the external shield and the internal lining to avoid moving away. Therefore, the reliability and the life span of the pad can be increased effectively.

3) It is very safe during sewing. Especially, the bag part is enclosed in the center between the external shield and the internal lining. The respective outer edge is provided with enough area for being sewed such that the risk of piercing the bag part can be avoided to promote the finish rate.

While the invention has been described with reference to a preferred embodiment thereof, it is to be understood that modifications or variations may be easily made without departing from the spirit of this invention, which is defined by the appended claims.

What is claimed is:

1. A brassiere pad, comprising:

an external shield having a first outer edge, an outer shield layer adhered to an inner shield layer made of foamed high molecular material, and having a first central area surrounded by the first outer edge to form a concave outer chamber;

an internal lining with a second outer edge, an outer lining layer made of high molecular material adhered to an inner lining layer, and having a second central area surrounded by said second outer edge, said second outer edge joined to said first outer edge; and a sealed bag formed completely between the external shield and the internal lining and disposed in the outer chamber, the sealed bag having a liquid therein.

2. The brassiere pad according to claim 1, wherein the bag is adhered to the inner shield layer.

3. The brassiere pad according to claim 1, wherein the outer shield layer and the inner lining layer are made of woven cloth.

4. The brassiere pad according to claim 3, wherein the woven cloth is polyester.

5. The brassiere pad according to claim 1, wherein the outer shield layer and the inner lining layer are made of foamed PU.

6. The brassiere pad according to claim 1, wherein the external shield and the internal lining joins together by way of heating in a die, respectively.

* * * * *